US005483729A

United States Patent [19]

Fayard

[11] Patent Number: 5,483,729

[45] Date of Patent: Jan. 16, 1996

[54] SHEARING MACHINE HAVING MULTIPLE CLOSE ADJUSTMENT DEVICES

[75] Inventor: Vincent Fayard, Lyons, France

[73] Assignee: GHM Industries, Inc., Worcester, Mass.

[21] Appl. No.: 245,748

[22] Filed: May 18, 1994

[51] Int. Cl.[6] ..... D06C 13/00

[52] U.S. Cl. ..... 26/15 R; 83/349

[58] Field of Search ..... 26/15 R, 16, 17, 26/15 FB; 83/349, 699.51

[56] References Cited

U.S. PATENT DOCUMENTS

| | | | |
|---|---|---|---|
| 627,342 | 6/1899 | La Fountain, Jr. | 26/15 R |
| 1,349,788 | 8/1920 | Sellers | 26/15 R |
| 2,362,770 | 11/1944 | Remington | 26/15 R |
| 2,695,438 | 11/1954 | Bejeuhr | 26/15 R |
| 3,215,179 | 11/1965 | Schill | 26/15 R |
| 3,262,483 | 7/1966 | Warnecke et al. | 26/15 R X |
| 3,769,666 | 11/1973 | Kaufman | 26/15 R |
| 3,908,245 | 9/1975 | Buthe | 26/15 R |
| 3,969,797 | 7/1976 | Riedel et al. | 26/15 R |
| 4,649,606 | 3/1987 | Fay | 26/15 R |

FOREIGN PATENT DOCUMENTS

| | | | |
|---|---|---|---|
| 3235161 | 3/1984 | Germany | 26/15 R |
| 336044 | 3/1959 | Switzerland | 26/15 R |

*Primary Examiner*—John J. Calvert
*Attorney, Agent, or Firm*—Blodgett & Blodgett

[57] ABSTRACT

A machine for shearing pile fibers from the surface of a textile fabric which is conveyed over the narrow edge of a cloth holder. The cutting is accomplished by a scissors-like action between a stationary cutting blade and a plurality of helical blades which are mounted on a roll which is rotated about a horizontal axis for moving the helical blades into cutting contact of the horizontal cutting edge of the stationary blade. The stationary blade is mounted on a holder which is pivotally mounted on a horizontal axis to enable the stationary blade holder to be pivoted by a drive mechanism to change the relative position of the cutting edge of the stationary blade relative to the cloth holder. The roller for the helical blades is mounted on a rotary blade holder which is supported on the stationary blade holder for movement with the stationary blade holder so that the cutting edges of both the stationary blades and the rotary blades and the helical blades move in unison relative to the cloth holder. The invention also includes apparatus for changing the relative portions of the cutting edge of the stationary blade relative to the cutting edges of the helical blades to compensate for wear of the blades and other conditions which may change the relative positions of the cutting edges of the blades from an ideal cutting relationship. The stationary blade is also provided with apertures to create an airflow through the stationary blade in conjunction with suction means which creates a vacuum in the cutting area. The machine also includes pile height adjusting mechanism for pivoting the stationary blade holder. Miniature video cameras are positioned at the ends of the machine for viewing on end the shearing area of the stationary and rotary blades where the cameras are connected to a video screen which enlarges the image of the cutting area for viewing by the operator and assisting the operator when making adjustment to various settings of the machine.

14 Claims, 8 Drawing Sheets

SHEARING MACHINE HAVING MULTIPLE CLOSE ADJUSTMENT DEVICES

BACKGROUND OF THE INVENTION

The present invention is directed to a shearing machine for textile fabric.

A shearing machine is a machine used in textile industry for cutting the fibers at the surface of fabrics, for cleaning the undesirable fibers from them, for equalizing the height of the pile of fabrics called velvets or imitation furs, or for cutting the top of plush loops on certain fabrics such as terry towel material, in order to give them a uniform surface appearance and thus to imitate velvet.

The cutting of these fibers is ensured by contact between a flat blade and spiral blades. These spiral blades have a helicoidal shape and are mounted on a roll or cutting cylinder. This curing cylinder has a rotational movement in the counterclockwise direction, as viewed from the right-hand side or from left to right in its lower part. As for the flat blade, it is stationary. The rotational movement of the cutting cylinder and of the spiral blades over the flat stationary blade causes an effect of multiblade scissors which cut the fibers.

The cut fibers are removed by strong suction. The friction between spiral blades and the flat blade causes heating of the flat blade, and therefore, there is a tendency to alter the characteristics of the steel and to considerably reduce the cutting duration with the fibers and of proper functioning of the machine. On the other hand, lubricating felt as well as the speed of the rotation of the cylinder tend to hinder the suction and to reduce its effectiveness.

The flat blade, is stationary. It is mounted on a support called the blade holder and immobilized on this blade holder by a blade strap or clamp. As already indicated, this flat stationary blade, blade holder and blade clamp are stationary, but they can be adjusted in a vertical position with respect to the cloth support which allows one to determine the height of the pile of fabric. The rotational movement of the rotary cutting cylinder of spiral blades over the flat stationary blade causes an effect of multiple scissors, as a function of the number of spiral blades which are mounted on the curing cylinder.

The contact between the spiral blades and the flat blade is therefore very important; the good quality of the cutting, the yield, the effectiveness, as well as the longevity of this quality, of this yield, and of this effectiveness depend on it.

Up to now, the contact between the spiral blades and the flat stationary blade has been ensured by either mechanical or electromechanical manual adjustments which exerted pressure on the blade. These adjustments consist of vertical movements of the cutting cylinder using micrometric screws. These movements have the effect of modifying, and as a general rule, of increasing the contact between the spiral blades and the flat stationary blade. These adjustments are approximate, they lack precision, and moreover, they include no indicators showing settings on the control panel of the machine. Consequently, the operator working on the machine has no means of checking the contact pressure existing between the spiral blades and the flat blade. On the other hand, with the flat stationary blade becoming worn because of the friction between the spiral blades and the flat stationary blade, this pressure, which cannot be checked, changes progressively as the flat blade becomes worn. It is therefore necessary to stop the machine from time to time in order to make new adjustments of the contact and pressure between the spiral blades and the flat blade.

The ends of the stationary blade holder are attached on the left part of the frame and the right part of the frame of the machine. This results in deflection in the lengthwise direction. This deflection is amplified by the cutting force between the flat blade and the spiral blades. This deflection contributes towards disturbing the contact between the flat stationary blade and the spiral blades, which is damaging to the high quality of the cutting, to the yield and to the effectiveness of the machine. In order to counteract this deflection, the blade tension device is attached under the blade holder and with the help of one or more tension screws tries to minimize the deflection of the blade holder. Currently these adjustments require stopping of the machine and are themselves also very approximate, imprecise, and without any control or indication on the control board of the machine.

The rotary cutting cylinder can also be adjusted in a horizontal position with respect to the flat stationary blade, so as to adjust, on one hand, the parallelism between the rotary cutting cylinder and the flat stationary blade, and on the other hand, the different cutting positions between the rotary cutting cylinder and the flat blade as a function of the fabric to be treated.

The cloth support can be adjusted in a vertical and horizontal position with respect to the flat stationary blade so as to adjust the vertical and horizontal parallelisms.

This assembly, consisting of the cutting cylinder, the spiral blades, a flat blade, blade strap or clamp, blade holder, and a cloth support therefore has a multitude of different adjustments, all of greatest importance. These adjustments are carried out using micrometric screws, moved either manually or by servomotors.

These and other difficulties experienced with the prior art devices have been obviated by the present invention.

It is therefore, it is an object of the invention to provide a shearing machine wherein the relative position of the cutting edge of the stationary blade relative to the cutting edges of the spiral blades can be adjusted during operation of the machine.

Another object of the invention is to remedy the two problems of heating and suction, by creating and airflow at both sides of the cloth support and through the stationary blade. This has the effect first, of improving the suction, and second, the cooling of the stationary blade.

A further object of the present invention is the provision of a support system for the blade holder which will remedy all these problems of adjustments of contact, adjustments of position, adjustments of pressure between the flat blade and the spiral blades by acting on important points.

A still further object of the invention is to provide pile height adjustment means which acts directly and the holder of the stationary blade for adjusting the position of the cutting edges of the stationary and rotary blades in unison relative to the cloth holder.

It is a further object of the invention to monitor the adjusted position of the stationary and rotary cutting blades relative to the cloth holder and the pressure which is applied to the stationary blade holder, i.e., through electronic sensors and digital display elements.

It is another object of the present invention to facilitate the adjustments and the checking of all these positions by the fitting of optical devices onto the machine, such as micro-cameras, optical fibers, video screens with graduated or transparent scales.

With these and other objects in view, as will be apparent to those skilled in the art, the invention resides in the combination of parts set forth in the specification and covered by the claims appended hereto.

SUMMARY OF THE INVENTION

A machine for shearing pile fibers from the surface of a textile fabric which is conveyed over the narrow edge of a cloth holder. The cutting is accomplished by a scissors-like action between a stationary cutting blade and a plurality of helical blades which are mounted on a roll which is rotated about a horizontal axis for moving the helical blades into cutting contact of the horizontal cutting edge of the stationary blade. The stationary blade is mounted on a holder which is pivotally mounted on a horizontal axis to enable the stationary blade holder to be pivoted by a drive mechanism to change the relative position of the cutting edge of the stationary blade relative to the cloth holder. The roller for the helical blades is mounted on a rotary blade holder which is supported on the stationary blade holder for movement with the stationary blade holder so that the cutting edges of both the stationary blades and the rotary blades and the helical blades move in unison relative to the cloth holder. The invention also includes means for adjusting the relative positions of the cutting edge of the stationary blade relative to the cutting edges of the helical blades to compensate for wear of the blades in other conditions which may change the relative positions of the cutting edges of the blades from an ideal cutting relationship. The stationary blade is also provided with apertures to create an airflow through the stationary blade in conjunction with suction means which creates a vacuum in the cutting area. Pile height adjusting mechanism for pivoting the stationary blade holder as well as the rotary blade holder is provided with electronic sensing devices for indicating the pivoting movement of the stationary blade holder as well as the pressure that is applied against the stationary blade holder by the pile high adjusting mechanism and, specifically, at a plurality of points along the width of the blade holder. These devices provide electrical signals to a central processing unit which is operatively connected to a display and control panel for observation and manipulation by the operator of the machine. Miniature video cameras are positioned at the ends of the machine for viewing on end the shearing area of the stationary and rotary blades. The cameras are connected to a video screen which enlarges the image of the cutting area for viewing by the operator and assisting the operator when making adjustment to various settings of the machine.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
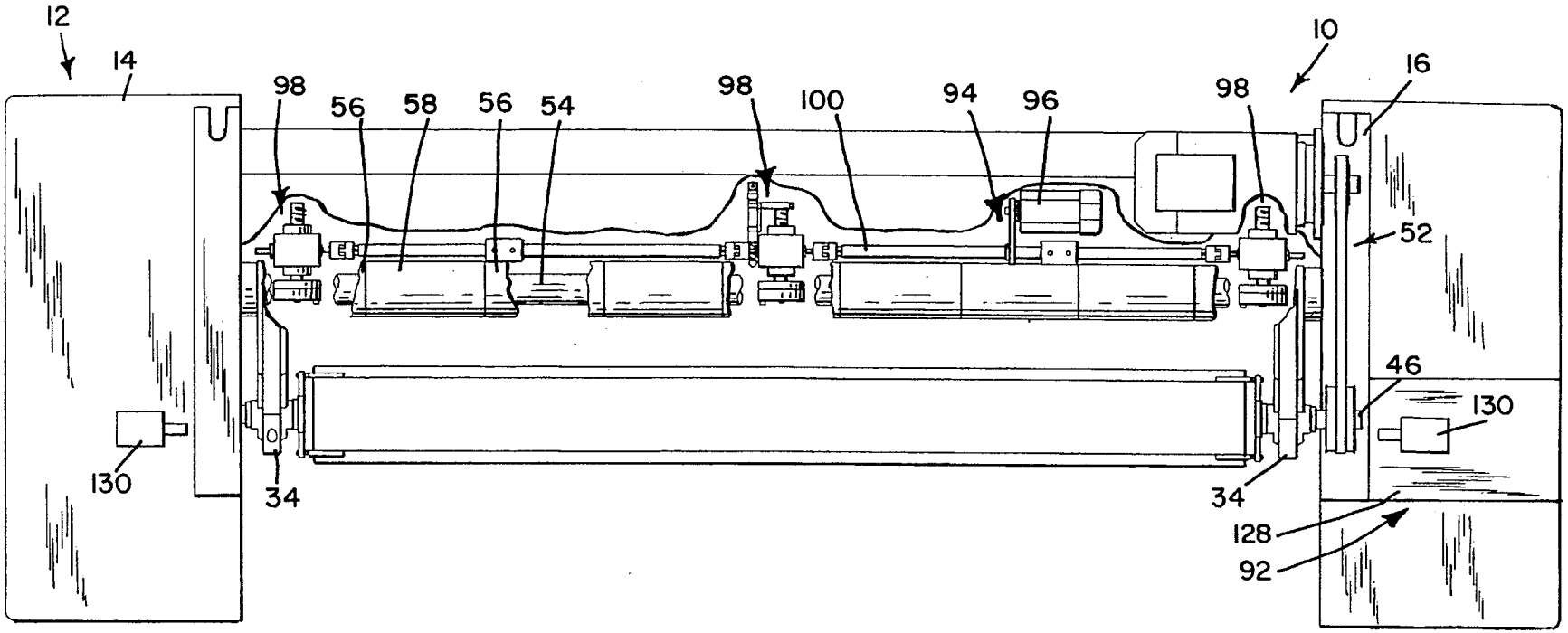
FIG. 1 is a top plan view of a shearing machine embodying the principles of the present invention.
Figure 2:
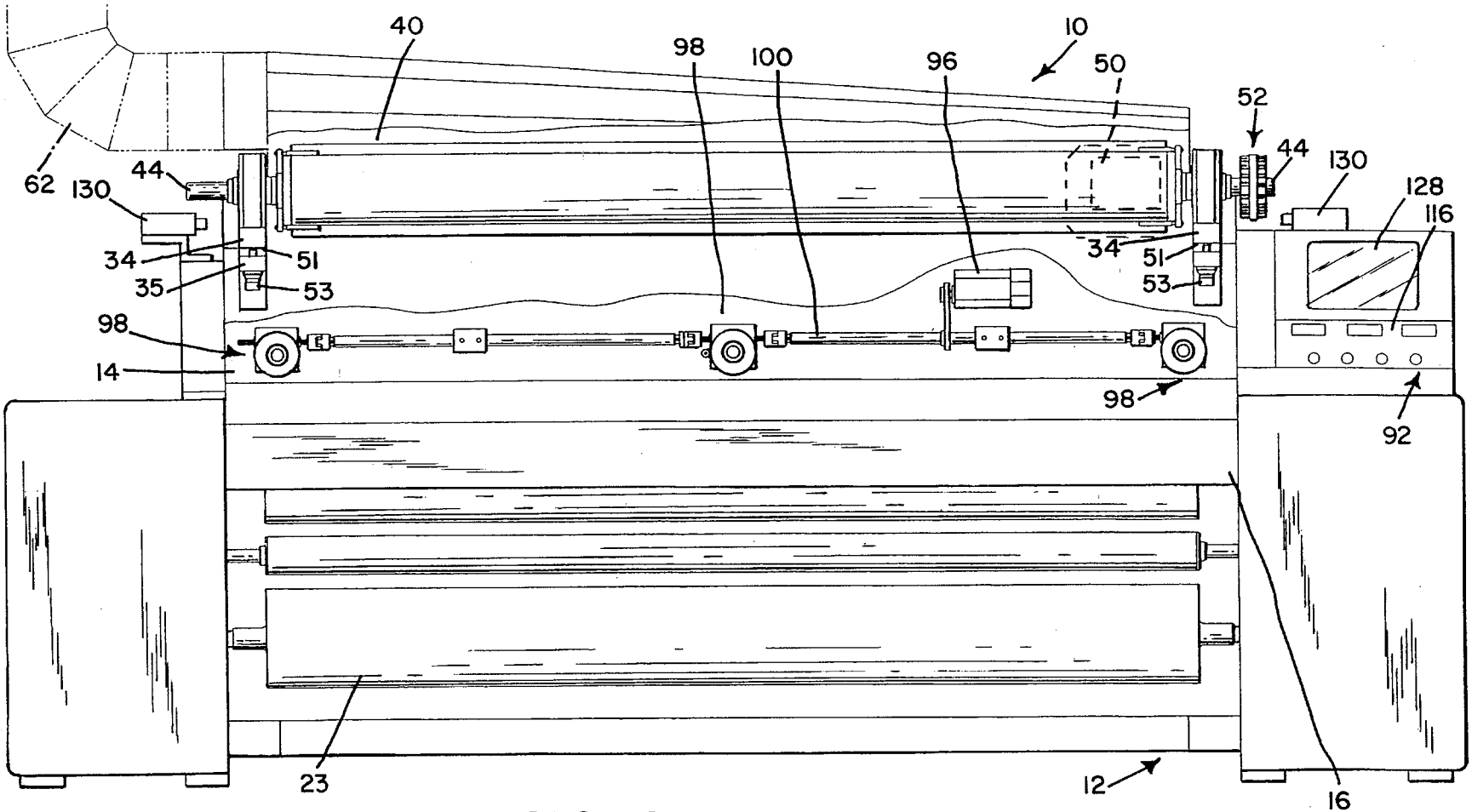
FIG. 2 is a front elevational view of the machine.
Figure 3:
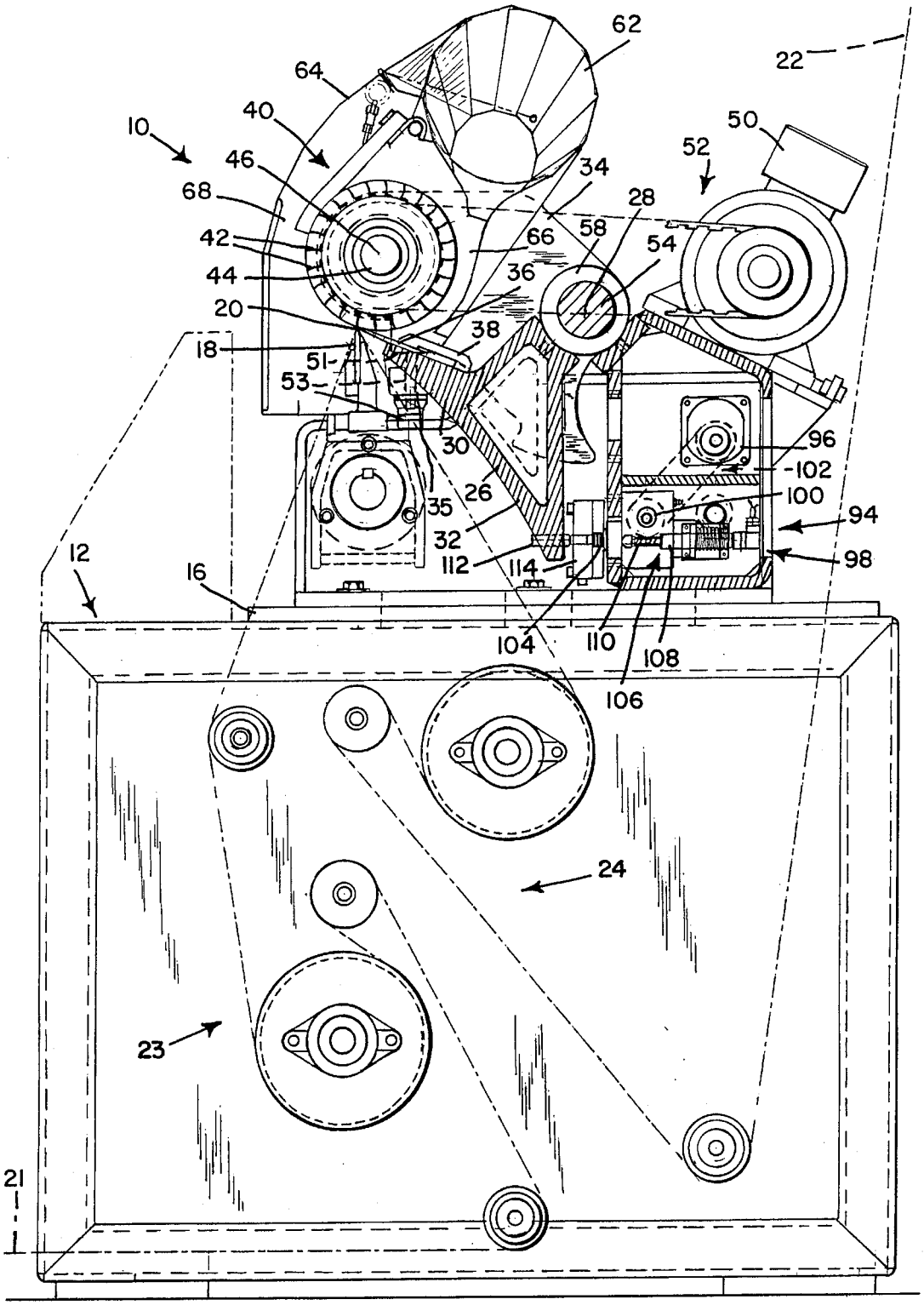
FIG. 3 is a right side elevational view of the machine.
Figure 4:
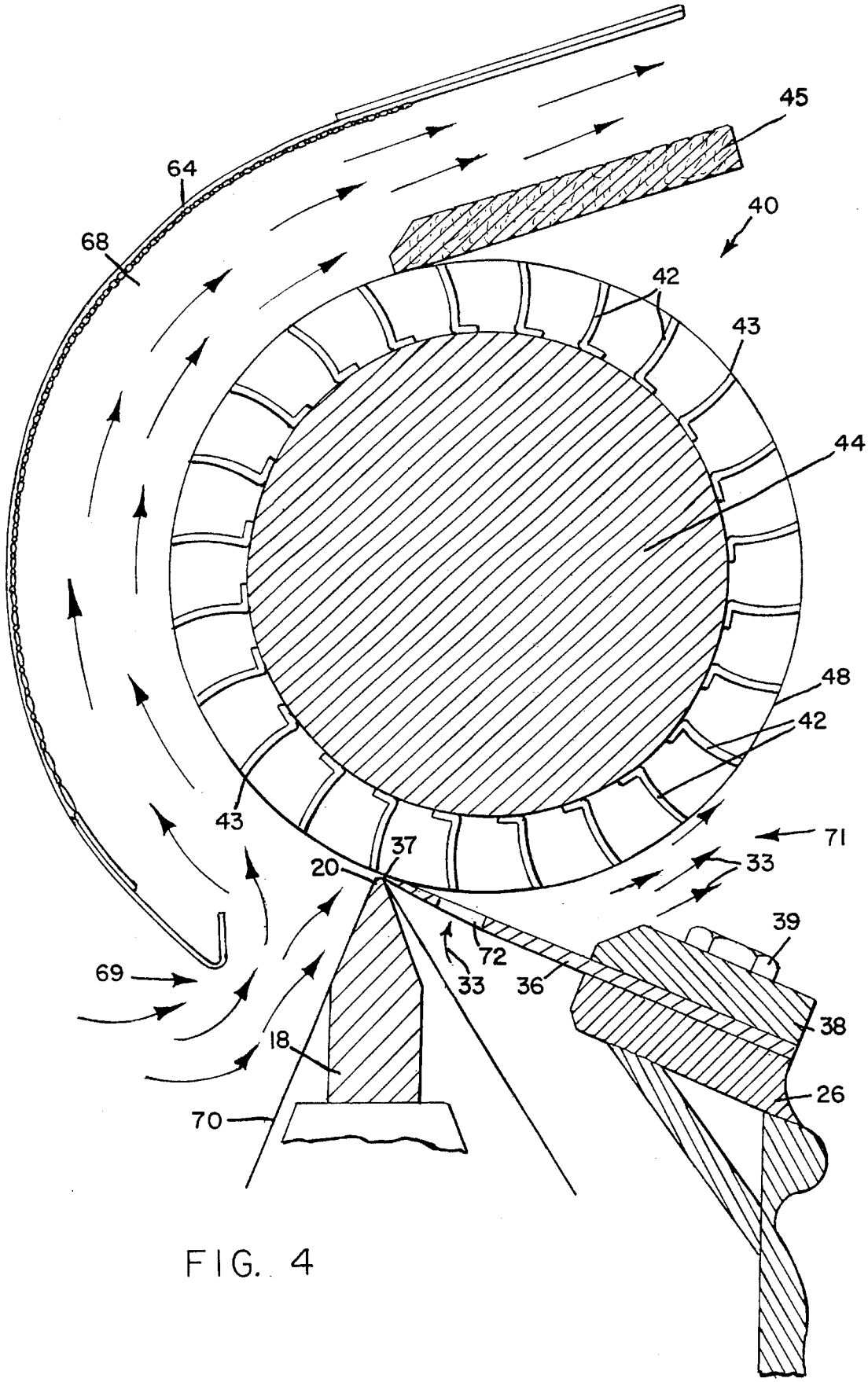
FIG. 4 is fragmentary side elevational view of the rotary and stationary cutting blades with portions in sections.

Referring first to FIGS. 1–3, the shearing machine of the present invention is generally indicated by the reference numeral 10 and comprises a fixed frame, generally indicated by the reference numeral 12. The frame 12 includes a first side structure 14 and a second side structure 16. A cloth support 18 is mounted in a fixed position relative to the frame and can be adjusted vertically by means well known in the art. The cloth support 18 tapers upwardly to a narrow horizontal top edge surface 20, shown more clearly in FIG. 4. The cloth to be sheared enters the machine from an outside source along the dot and dash path 21 and is looped around a series of motor driven guide rolls, generally indicated by the reference numeral 23, to the top edge 20, at which point shearing of fibers from one surface of the cloth occurs. After shearing, the cloth travels from the top edge 20 to a series of guide rolls, generally indicated by the reference numeral 24, and away from the machine along an exit path, indicated by the dot-dash line 22.

A stationary blade holder 26 extends horizontally between the left and right side structures 14 and 16, respectively. It is pivotally mounted about a first horizontal axis 28. The blade holder has a forward portion 30 which extends forwardly and upwardly and a rearward portion 32 which extends rearwardly and downwardly. A rotary blade holder which consists of a pair of arms 34 which are pivotally mounted about the horizontal axis 28. The arms 34 are pivoted independently of the stationary blade holder 26 and rest on micrometric screws 53 which are threaded through a forwardly extending shoulder 35 of the stationary blade holder 26 at each end of the machine. The stationary blade holder 26 supports a flat stationary cutting blade 36 which has a free horizontal cutting edge 37 which is located above the horizontal top edge surface 20 of the cloth holder 18. The stationary cutting blade 36 is maintained on the stationary blade holder 26 by a clamping bar 38 which is fixed to the blade holder 26 by machine screws 39, see FIG. 4. A rotary cutting assembly, generally indicated by the reference numeral 40 is mounted on a shaft 44 which is mounted on the arms 34 of the rotary, blade holder for rotation about a second horizontal axis 46. The rotary cutting assembly 40 includes a plurality of outwardly projecting cutting blades 42. Each curing blade 42 has a spiral or helicoidal shape. The rotary cutting assembly 40 is rotated about the horizontal axis 46 by a motor 50 and drive connecting mechanism generally indicated by the reference numeral 52. As the assembly 40 rotates about the axis 46, the cutting edges 43 travel in a circle 48 in a counterclockwise direction as viewed in FIGS. 3 and 4. The cutting edges 43 intersect the cutting edge 37 of stationary blade in a scissors-like cutting relationship for severing fibers which extend upwardly from the surface of the cloth 70 as it is conveyed over the horizontal top edge surface 20 of the cloth holder 18. The blade holder (arms 34) and the rotary cutting assembly 40 are biased as a unit in a counterclockwise direction as viewed in FIG. 3 by its own weight so that the arms 34 of the rotary blade holder rest against micrometric screws 53 which are adjustably mounted on the stationary blade holder 26. This causes the rotary blade holder to pivot about the first horizontal axis 28 with the stationary blade holder 26 when the stationary blade holder 26 is adjustably pivoted by mechanism to be described. This enables the cutting edge 37 of the stationary blade and the curing edges 43 of the rotary cutting blades 42 to move in unison toward and away from the horizontal top edge surface 20 as a result of a pile height adjusting mechanism to be described.

Each arm 34 of the rotary blade holder has a forwardly projecting portion or shoulder which has a downwardly lacing surface 51. The upwardly projecting end of a micrometric screw 53 is located beneath each surface 51 for engaging the surface 51. The arms 34 are raised and lowered relative to the stationary blade holder 26 by the appropriate rotation of the screws 53. This enables the operator to change the position of the cutting edges of the rotary blades 42 relative to the cutting edge 37 of the stationary blade 36 to achieve an optimum cutting relationship between and rotary and stationary cutting edges. This enables the operator to adjust for changes in the ideal cutting relationship due to many factors such as wear of the blades. A small rotation of the screws 53 create an even smaller vertical movement of the arms 34 and, consequently, the rotary blades 42. For example, a 12' rotation of each screw causes the screw to move vertically one and one half thousand's of an inch. Since each screw 53 is adjusted independently, the parallelism between the rotary and stationary cutting blades can also be adjusted. The adjustment is so fine that it can be achieved while the machine is running. It is also preferred to employ a micrometric adjusting screw which produces sensory indications such as clicks at predetermined angles of rotation so that the operator knows how much adjustment is being actually made to the relative positions of the cutting blades.

Figure 5:
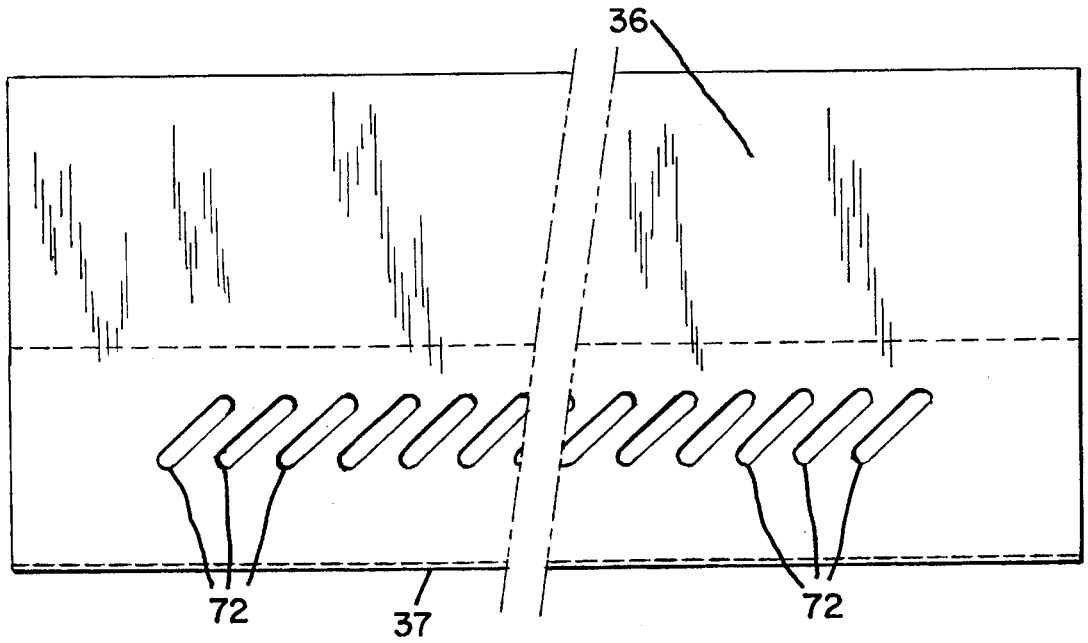
FIG. 5 is a top plan view of the stationary cutting blade.

The pivotal connection of the stationary blade holder 26 relative to the frame comprises a plurality of spaced b caring arms 56 which are fixed to the frame. Each bearing arm has a horizontal bore which is coaxial with the horizontal shaft 28. A horizontal shaft 54 extends through the bores of the bearing arms 56. The stationary blade holder 26 has a plurality of spaced hinge arms 58 which are pivotally mounted on the shaft 54 in the spaces between the beating arms 56. Support for the stationary blade holder by this arrangement across the width of this machine provides stability and prevents deflection of the stationary blade holder. An air conduit 62 is fixed to the machine frame 12 and is connected to a shroud 64 which partially surrounds the rotary cutting assembly 40, as shown most clearly in FIGS. 3 and 4. Forward and rearward air channels 68 and 66 are formed between the shrouds 64 and the rotary curing assembly 40 which lead to the conduit 62. A lubricating felt 45 is positioned in the channel 68 at the top of the rotary cutting assembly 40 for applying a lubricating fluid to the cutting edges 43 as the blades 42 pass beneath the lubricating feet 45. The forward end of the stationary cutting blade 36 has a plurality of oblique elongated apertures 72, see also FIGS. 4 and 5. Each aperture 72 is elongated along an axis which is at an acute angle to the cutting edge 37. All of the apertures 72 are parallel as shown in FIG. 5. The conduit 62 is connected to a source of subatmospheric pressure, not shown, which creates a vacuum in each of the air channels 68, 66. Air is drawn into the channel 68 through an opening 69 between the shroud 64 and the fabric 70 which lies in front of the cloth holder 18. Air is also drawn into the channel 66 through an opening 71 between the shroud and the stationary blade holder 26 and the blade, see FIG. 3. The apertures 72 in the blade 36 also enable air to be drawn into the air channel 66 at a higher velocity because of the limited total area of these openings which bas the effect of increasing suction near the cutting point of the fibers just after they have been cut to improve the cleaning of fibers from this area. This also causes cooling of the stationary blade as the air passes through the apertures.

Figure 6:
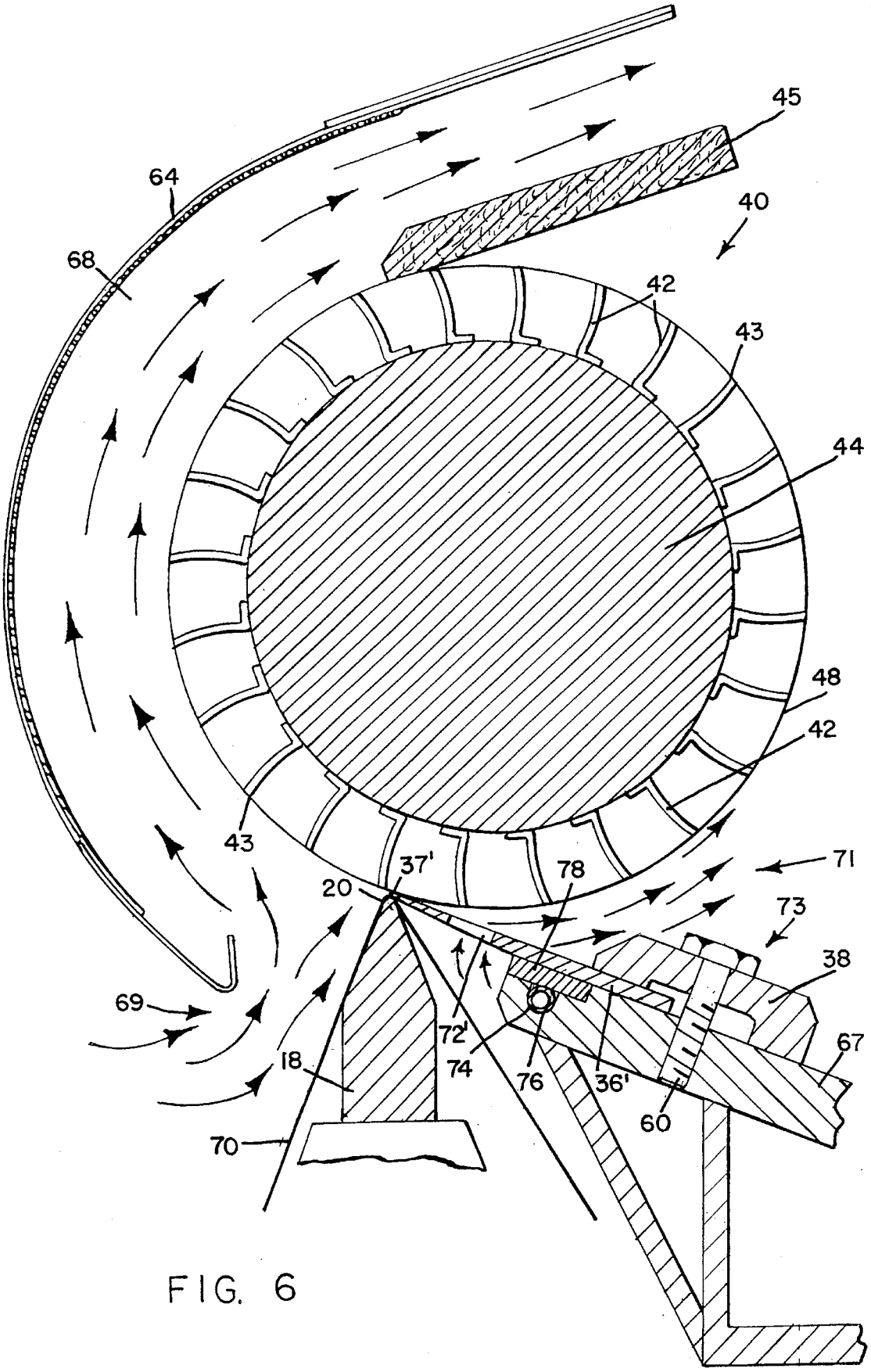
FIG. 6 is a fragmentary vertical cross-sectional view of a modified adjusting system for adjusting the relative positions of the stationary and rotary curing blades.
Figure 7:
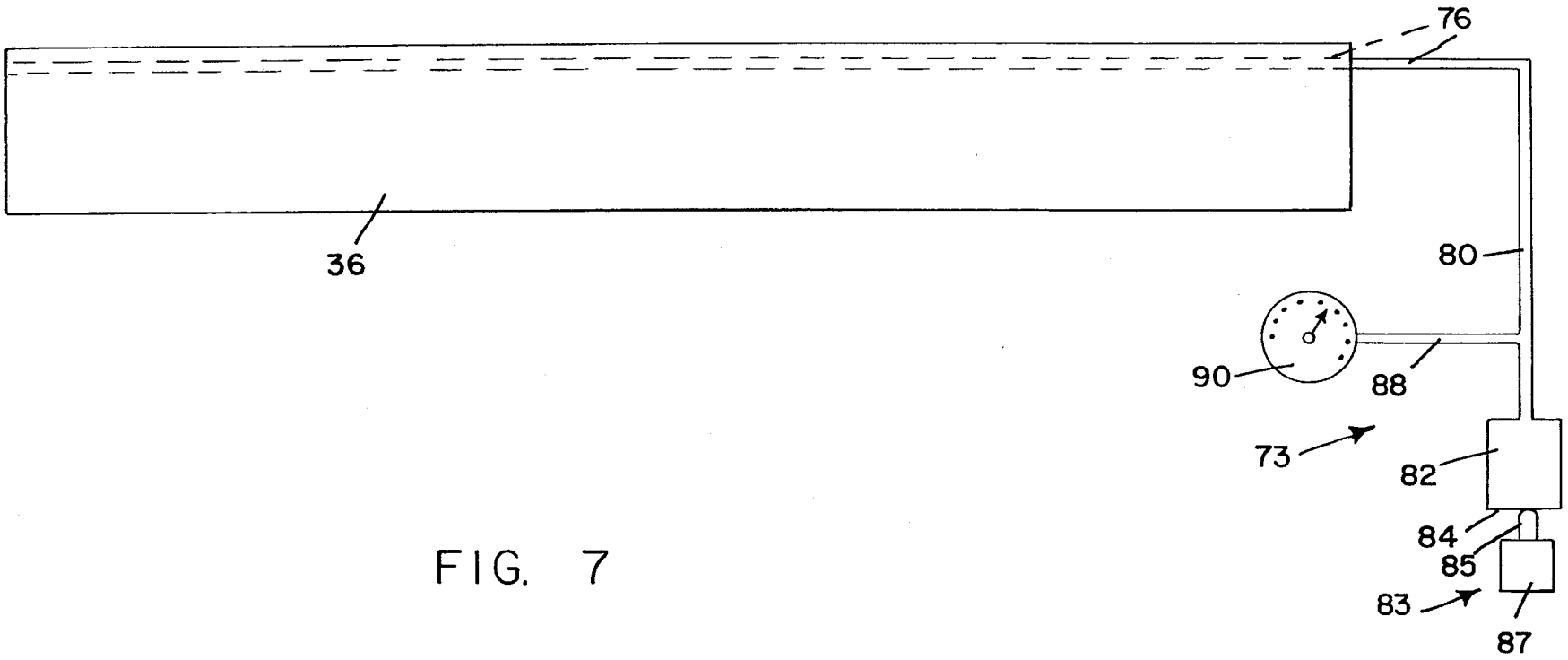
FIG. 7 is a diagrammatic view of the modified adjusting system of FIG. 6.

Referring to FIGS. 6 and 7, there is shown a blade adjusting system, generally indicated by the reference numeral 73 for adjusting the position of the cutting edge 37' of the stationary blade 36' relative to the cutting circle 48 of the rotary blade cutting edges 43. The adjusting system 73 includes a sealed expandable tube 76 which lies in a groove 74 in the upper forward portion of a modified stationary blade holder 67. The tube 76 is made of a material which expands in response to a predetermined pressure of fluid within the tube. For example, a strong metallic material with a certain degree of elasticity, such as steel, can be used. The tube 76 is located below the stationary blade 36'. An elongated flat plate is located between the tube 76 and the blade 36 as shown in FIG. 6 so that expansion of the tube 76 transmits an upward force to the blade 36' through the plate 78. This causes the inward portion of the blade to deflect upwardly from its clamped portion. The tube 76 is operatively connected to a sealed tank 82 through a hydraulic line 80 and to a pressure indicator 90 through a branch hydraulic line 88. The tank 82 is filled with hydraulic fluid and has a resiliently deformable wall 84. Hydraulic pressure within the tank 82 is increased by applying a predetermined force against the wall 84 by an actuated mechanism, generally indicated by the reference numeral 83. The actuated mechanism 83 can include any one of a number of conventional, mechanical or electromechanical devices, such as a low speed hydraulic drive 87 which actuates a plunger 85 that impinges upon the wall 84, the expansion of the tubes 76 in response to a change in pressure in the tank 82 is very small. The resulting movement of the cutting edge 37' of the stationary blade and the cutting edges 43 of the rotary blades 42 is very small so that the amount of deflection of the stationary blade 36' is very small, resulting in very slight and precise adjustments of the cutting edge 37'. Adjustments of the cutting edge 37' relative to the cutting edges 43 can be made while the machine is running by examining the finished cloth as it is being sheared and, simultaneously, making final adjustments to the position of the cutting edge 37' of the stationary blade until an optimum result is achieved in the sheared fabric without stopping and restarting the machine for adjustments. An indicator 90 is connected to the terminal of a central processing unit generally indicated by the reference numeral 92, see FIG. 2, so that the pressure can be checked, stored in memory and modified as a function of the type of fabric to be treated.

Figure 8:
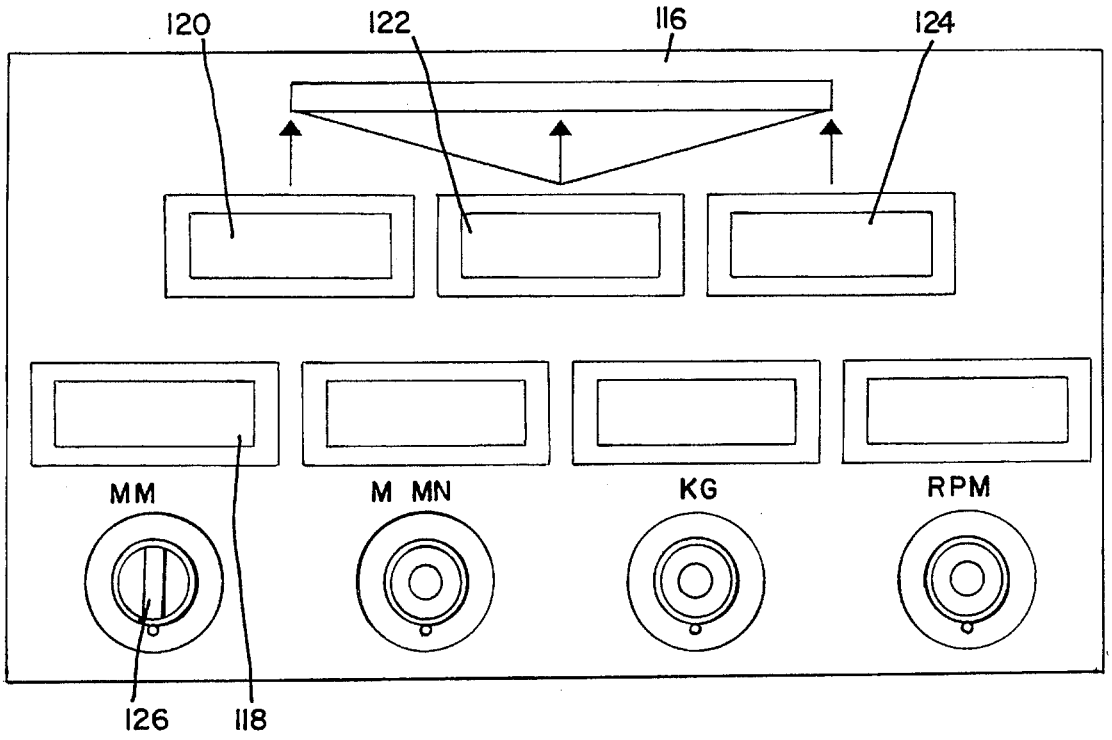
FIG. 8 is a front elevational view of a control and display panel.

Referring to FIGS. 1–3, the shearing machine is equipped with a pile height adjusting mechanism which is generally indicated by the reference numeral 94. The adjusting mechanism 94 includes an electric motor 96 which is mounted on the frame 12. The motor 96 drives a drive shaft 100 through a drive coupling, generally indicated by the reference numeral 102, which in the embodiment shown in the drawings is a timing belt drive. The drive shaft 100 is drivingly connected to a plurality of transmission units, generally indicated by the reference numeral 98, which are also mounted to the frame to the rear of the stationary blade holder 26. Each transmission unit 98 is effective to move a screw 104 axially toward and away from the rearward portion 32 of the stationary blade holder 26. The forward end of the screw is spaced from the rearward portion 32, a pressure transducer 114 is interposed between the forward end of the screw 104 and the rearward portion 32 of the stationary blade holder. The pressure transducer 114 actually engages a projecting pin 112 which is fixed to the portion 32. The pressure transducer 114 is operatively connected to an electrical control mechanism, including the central processing unit 92, and generates an electrical signal which is indicative of the pressure that is applied to the pin 112 by the screw 104. A potentiometer, generally indicated by the reference numeral 106, includes a first portion 108 which is operatively connected to the screw 104 and moves axially with the screw and a second portion 110 which is telescopically mounted within the first portion 108 for axial movement relative to the first portion 108. The portion 110 is biased outwardly from the portion 108 by a spring and bears against a surface of the fixed frame 12. As the screw 104 is advanced axially, the relative movement between the portions 108 and 110 of the potentiometer 106 provide a electrical signal to the central processing unit 92 which is indicative of the relative position of the screw 104. Prior to running the machine, each transmission unit 98 is set or calibrated so that the potentiometer is at a zero position and each pressure transducer indicates a predetermined compressive force against the rear portion 32 of the stationary blade holder. The compressive forces may be the same for all transmission units or selectively different for different operating conditions. The central processing unit 92 has a control and indicator panel 116, see also FIG. 8, which enables the operator to determine the relative position of the stationary and rotary cutting blades relative to the horizontal top edge 20 of the cloth support. This relative position is indicated by a digital display 118. The pressure which is applied to the rear portion 32 by each of the transmission units 98 is indicated by the digital displays 120, 122, and 124. In the example shown in FIG. 1, one transmission unit 98 is located in the center and at each end of the machine. The digital displays 120, 122, and 124 provide information to the operator as to whether the pressures which are applied across the width of the rear portion 32 of the stationary blade holder equal predetermined pressure valves for each transmission unit. The position for cutting blades relative to the horizontal top edge surface 20 of the cloth holder to vary the pile height of the fabric to be sheared is changed by turning a three position switch 126 which starts the motor 96 so that any adjustment of the cutting position can be read immediately through the distal display 118. Turning the switch 126 in one direction causes the motor 96 to move the screws 104 forwardly. Turning the switch 126 in the opposite direction causes the motor 96 to move the screws rearwardly.

Referring to FIG. 2, a small video camera 130 is mounted on the frame of the machine to each end of the machine. Each camera 130 is positioned to view the end wise positions of the horizontal top edge surface 20 to the cutting edge 37 of the stationary blade and the cutting edges 43 of the rotary blades 42. The cameras 130 are operatively connected to a video display screen 128 which is mounted on top of the frame. This enables the end wise view of the cutting edges of the blades and the cloth holder to be greatly magnified so that even small adjustments which would be interceptible to an operator can be very easily seen through the image on the video display screen 128. This greatly assists the operator when making very fine adjustments between the stationary and rotary cutting edges and cloth 2*a* rest against ledger blade 37, augmenting the results of the adjustments from examination of a finished cloth as it leaves the shearing area. All of this adjustment in checking can be done while the machine continues to operate. The cameras visual display are also useful when the machine is stopped for making initial settings and adjustments. The visual display elements are also useful for enabling the operator to make adjustments in pile height and augments the information which the operator obtains from the digital readout 118 in the control panel.

The invention having been thus described, what is claimed as new and desired to secure by Letters Patent is:

1. A shearing machine for cutting fibers at the surface of a textile fabric, said machine comprising:

(a) a fixed frame, having a first side structure at one end of eh machine and a second side structure at an opposite end of the machine;

(b) a horizontal cloth support fixed to said fixed frame, said horizontal cloth support having a horizontal top edge surface for supporting the fabric;

(c) a stationary blade holder which extends from said first side structure to said second side structure, said stationary blade holder being pivotally mounted to said frame for pivoting about a first horizontal axis, said stationary blade holder having a forward end located at one side of said axis and a rearward end located at an opposite side of said axis from said one side, said stationary blade holder being rearward of said horizontal cloth support;

(d) a rotary blade holder pivotally mounted to said frame for pivoting about said first horizontal axis relative to said stationary blade holder and operatively connected to said stationary blade holder for pivoting with said stationary blade holder around said first horizontal axis:

(e) a stationary cutting blade which is fixed to the forward end of said stationary blade holder, said stationary cutting blade having a horizontal free cutting edge which is located adjacent said horizontal top edge for shearing upwardly extending fibers of a fabric which is passed between said horizontal top edge and said horizontal free cutting edge;

(f) a rotary cutting assembly which is located above said stationary cutting blade and mounted on said rotary blade holder for rotation about a second horizontal axis, said rotary cutting assembly having a plurality of outward extending projecting cutting blades having cutting edges which travel in a circular path and which intersect the free cutting edge of the fixed blade as said rotary cutting assembly is rotated about said second horizontal axis, the cutting edge of each of said projecting cutting blades forming a scissors-like relationship with said horizontal free cutting edge for cutting fibers which extend upwardly from the upper surface of said textile fabric; and (g) adjusting means which is operatively connected to the rearward end of said stationary blade holder for selectively and adjustably pivoting said stationary and rotary blade holders about said first horizontal axis to selectively move the free cutting edge of said stationary blade and the circular path of the cutting edges of said upwardly extending projecting cutting blades toward and away from the horizontal top edge surface of said cloth support for selectively varying the length of fiber which is to be cut from the textile fabric.

2. A shearing machine as recited in claim 1, said stationary blade holder is biased for pivoting in a direction which lowers the free cutting edge of said stationary blade toward said cloth support and wherein said adjusting means comprises an electromechanical drive fixed to said frame and which includes a plunger for movement selectively toward and away from the rearward end of the blade holder, wherein movement of said plunger toward the rearward end of the blade holder against the bias, thereby causing the free cutting edge of the stationary blade and the circular path of said projecting cutting blades to move away from the horizontal top surface edge surface of the cloth support.

3. A shearing machine as recited in claim 2, wherein said electromechanical drive comprises several drive units at spaced points along the length of the rearward end of said blade holder, each of the drive units having a plunger for engaging the rearward end of the blade holder.

4. A shearing machine as recited in claim 3, wherein each of said drive units comprises a potentiometer for sensing a position of the respective plunger relative to said frame and for generating an electrical signal which corresponds to the relative position of the plunger, said shearing machine further comprising electrical control and display means operatively connected to each of said potentiometer for providing a visual indication of the position of the free cutting edge of the stationary blade relative to the top horizontal edge surface of the cloth support.

5. A shearing machine as recited in claim 4, wherein each of said drive units comprises a pressure transducer which is located between the plunger and the rearward end of said stationary blade holder for operating an electrical signal which is indicative of pressure which is applied by the drive unit to the rearward end of said stationary blade holder, each of said pressure transducers being operatively connected to electrical control and display means for providing a visual indication of the pressure which is sensed by each of said pressure transducers, each of said drive units being individually actuatable to achieve a uniform application of pressure against the rearward end of the blade holder by all of said drive units.

6. A shearing machine as recited in claim 3, wherein said machine further comprises:

(a) a pressure transducer for each of said drive units which is located between the plunger and the rearward end of said stationary blade holder for generating an electrical signal which is indicative of pressure which is applied by the drive unit to the rearward end of said stationary blade holder; and (b) electrical control and display means operatively connected to each of said pressure transducers for providing a visual indication of the pressure which is sensed by each of said pressure transducers, each of said drive units being individually adjustable to achieve a uniform application of pressure against the rearward end of the blade holder by all of said drive units.

7. A shearing machine as recited in claim 2, wherein said electromechanical drive comprises:

(a) a potentiometer for sensing a position of said plunger relative to said frame and for generating an electrical signal corresponding to the relative position of the plunger; and (b) electrical control and display means operatively connected to said potentiometer, for providing a visual indication of the position of the free cutting edge of the stationary blade relative to the top horizontal edge of the cloth support.

8. A shearing machine as recited in claim 1, wherein said shearing machine further comprises:

(a) a video camera which is mounted on said frame for sighting axially along the free cutting edge of said stationary blade and the top edge surface of said cloth support: and (b) a video display unit which is mounted on said frame and operatively connected to said video camera for providing visual display of tho relative positions of said free cutting edge and said horizontal top edge surface.

9. A shearing machine as recited in claim 1, wherein the pivotal connection between said frame and said stationary blade holder comprises:

(a) a plurality of spaced bearing arms which are fixed to said frame, each of said bearing arms having a horizontal bore, the bores of said bearing arms being aligned along said first horizontal axis;

(b) a horizontal shaft which extends through said bores; and (c) a plurality of spaced hinge arms which are fixed to said stationary blade holder and which are pivotally mourned on said shaft, said hinge arms interdigitating with said spaced bearing arms.

10. A shearing machine as recited in claim 1, wherein said machine further comprises blade adjusting means operatively connected to said rotary and stationary blade holders for selectively pivoting the rotary blade holder about said first horizontal axis relative to said stationary blade holder for adjusting the position of the cutting edges of said outwardly projecting cutting blades relative to the free cutting edge of said stationary cutting blade.

11. A shearing machine as recited in claim 10, wherein said blade adjusting means comprises:

(a) a first forwardly extending shoulder on .said rotary blade holder;

(b) a second forwardly extending shoulder on said stationary blade holder which is vertically aligned with said first forwardly extending shoulder; and (c) an adjusting screw which is threaded into one of said first and second forwardly extending shoulders, said adjusting screw having a free end for engagement with the other of said first and second forwardly extending shoulders.

12. A shearing machine as recited in claim 11, wherein a first and second forwardly extending shoulder and an adjusting screw are positioned at each end of the machine.

13. A shearing machine as recited in claim 12, wherein said rotary blade holder comprises a pair of spaced supporting arms which are pivotally mounted on said frame for rotation about said first horizontal axis for supporting said rotary cutting assembly therebetween, one of the forwardly extending shoulders being located on one said spaced supporting arms and the other forwardly extending shoulders being located on the other of said spaced supporting arms.

14. A shearing machine for cutting fibers from a surface of a textile fabric said machine comprising:

(a) a fixed frame, which has a first side structure at one end of the machine and a second side structure at an opposite end of the machine;

(b) a horizontal cloth support which is fixed to said frame, said cloth support having a horizontal top edge surface for supporting the fabric which is to be sheared;

(c) a stationary blade holder which extends from said first side structure to said second side structure, said blade holder being pivotally mounted to said frame for pivoting about a first horizontal axis, said blade holder having a forward end which is forward of said axis and a rearward end which is rearward of said axis, said blade holder being rearward of said cutting table, the pivotal connection between said frame and said stationary blade holder comprising:

(1) a plurality of spaced bearing arms which are fixed to said frame, each of said bearing arms having a horizontal bore, the bores of said bearing arms being aligned along said first horizontal axis;

(2) a horizontal shaft which extends through said bores; and (3) a plurality of spaced hinge arms which are fixed to said stationary blade holder and which are pivotally mounted on said shaft, said hinge arms interdigitating with said spaced bearing arms;

(d) a rotary blade holder which is mounted on said frame for pivoting around said first horizontal axis;

(e) a stationary cutting blade which is fixed to the forward end of said blade holder, said stationary cutting blade having a horizontal free cutting edge which is located adjacent said top edge so that said fabric passes between said top edge and said free cutting edge, and the fibers to be sheared extend above said free cutting edge;

(f) a rotary cutting assembly which is located above said stationary cutting blade and which is mounted on said rotary blade holder for rotation about a second horizontal axis, said rotary cutting assembly having a plurality of outwardly projecting cutting blades which have cutting edges that travel in a circular path which intersects the free cutting edge of said fixed blade as said rotary cutting is rotated about said second horizontal axis, the cutting edge of each of said projecting cutting blades forming a scissors-like curing relationship with said free cutting edge for cutting fibers which extend upwardly from the upper surface of said textile fabric; and (g) adjusting means operatively connected to said stationary and rotary blade holders for adjustably pivoting said stationary and rotary blade holders about said first horizontal axis, to selectively move the free curing edge of said stationary blade and the circular path of the cutting edges of said projecting blades toward and away from the horizontal top edge surface of said cloth support for selectively varying the length of fiber which is to be cut from the textile fabric.

* * * * *